US005529816A

United States Patent [19]

Sartini et al.

[11] Patent Number: 5,529,816

[45] Date of Patent: Jun. 25, 1996

[54] PROCESS FOR CONTINUOUS HOT DIP ZINC COATING OF ALMINUM PROFILES

[75] Inventors: Ramond J. Sartini, Farmington Hills, Mich.; Leiv A. Folkedal; Edward J. Morley, both of Kopervik, Norway; Morten Syslak, Onsted, Mich.

[73] Assignee: Norsk Hydro a.s., Oslo, Norway

[21] Appl. No.: 486,155

[22] Filed: Jun. 7, 1995

Related U.S. Application Data

[63] Continuation of Ser. No. 224,779, Apr. 8, 1994, abandoned.

[51] Int. Cl.[6] ..... B06B 1/00

[52] U.S. Cl. ..... 427/600; 427/601; 427/433; 427/434.2; 427/436; 427/443.2

[58] Field of Search ..... 427/600, 601, 427/433, 434.2, 436, 443.2

[56] References Cited

U.S. PATENT DOCUMENTS

| | | | |
|---|---|---|---|
| 2,895,845 | 7/1959 | Jones et al. | 427/601 |
| 3,942,705 | 3/1976 | Barbay | 427/433 |
| 3,969,544 | 7/1976 | Obeda | 427/57 |
| 4,042,725 | 8/1977 | Nomaki et al. | 427/601 |
| 4,891,275 | 1/1990 | Knoll | 428/650 |
| 5,316,206 | 5/1994 | Syslak et al. | 228/183 |

FOREIGN PATENT DOCUMENTS

| | | | |
|---|---|---|---|
| 0222397 | 12/1992 | European Pat. Off. | B27K 1/20 |

*Primary Examiner*—Benjamin Utech
*Attorney, Agent, or Firm*—Gary M. Hartman; Domenica N. S. Hartman

[57] ABSTRACT

An improved process is provided for forming a zinc-base alloy coating on an aluminum alloy profile, such as a tube or microtube used in the assembling and brazing of a heat exchanger which is suitable for automotive applications. The process of the present invention is a continuous, high speed coating technique which can utilize aluminum alloy profiles on which an aluminum oxide layer is present. Accordingly, the present invention encompasses an operation by which the aluminum oxide layer is removed so as to enable the zinc-base alloy to metallurgically adhere to the surface of the aluminum alloy profile. The process of this invention also is capable of closely controlling the thickness of the zinc-base alloy coating, such that a sufficient but minimal amount of coating is present to furnish corrosion protection as well as provide sufficient filler metal for a subsequent soldering or low temperature brazing operation.

10 Claims, 1 Drawing Sheet

PROCESS FOR CONTINUOUS HOT DIP ZINC COATING OF ALMINUM PROFILES

This is a continuation of application Ser. No. 08/224,779, filed on Apr. 8, 1994 now abandoned.

The present invention relates to an improved process for coating aluminum profiles with a zinc alloy for enhanced corrosion resistance and/or for enabling a subsequent soldering or brazing operation, and particularly aluminum profiles such as aluminum tubes used in heat exchanger assemblies for engine radiators and air conditioning condensers. More particularly, this invention relates to an improved process for applying a zinc alloy coating to such aluminum profiles, wherein the method entails a continuous hot dip galvanizing process which produces an evenly distributed coating whose thickness can be closely controlled.

BACKGROUND OF THE INVENTION

Heat exchangers are routinely employed within the automotive industry, such as in the form of radiators for cooling engine coolant, condensers and evaporators for use in air conditioning systems, and heaters. In order to efficiently maximize the amount of surface area available for transferring heat between the fluid within the heat exchanger and the environment, the design of the heat exchanger is typically a tube-and-fin type, which contains a number of tubes that thermally communicate with high surface area fins. The fins enhance the ability of the heat exchanger to transfer heat from the fluid to the environment, or vice versa.

To further enhance heat transfer efficiencies, the tubes may be in the form of "microtubes." A microtube is generally distinguishable from a standard heat exchanger tube by having a relatively small and flat cross-section, for example, on the order of about 1.7 by about 25 millimeters, and very thin walls, for example, on the order of about 0.2 to about 0.4 millimeter. As such, microtubes offer a larger surface area for a given cross-sectional area, with enhanced thermal conduction through the tube wall due to the wall being significantly thinner than that of a standard heat exchanger tube.

Increasingly, heat exchangers used in the automotive industry are being formed from aluminum alloys for the purpose of minimizing the weight of automobiles. Conventionally, such heat exchangers are constructed using one of several methods. One method utilizes mechanical expansion techniques and has been traditionally used for mass-producing radiators. Mechanical expansion techniques rely solely on the mechanical joining of the components of the heat exchanger to ensure the integrity of the heat exchanger, such as the joining of the tubes to the fins. Advantages of this method of assembly include good mechanical strength and avoidance of joining operations which require a furnace operation, while disadvantages include inferior thermal performance and relatively large size.

To overcome the disadvantages of the mechanical expansion-type heat exchangers, heat exchangers are increasingly being formed by a brazing operation. Such methods generally entail fixturing the individual components of a heat exchanger together, and then permanently joining the components with a suitable brazing alloy during a furnace operation to form the heat exchanger assembly. Generally, brazed heat exchangers are lower in weight and are better able to radiate heat as compared to mechanical expansion-type heat exchangers. An example of such a heat exchanger is referred to as the serpentine tube-and-center type, which involves one or more serpentine-shaped tubes which traverse the heat exchanger in a circuitous manner. The serpentine-shaped tubes are brazed to a number of high surface area finned centers to enhance heat transfer to the environment through thermal convection. Another type of heat exchanger is referred to as the headered tube-and-center type, or parallel flow type, and involves a number of parallel tubes which are brazed to and between a pair of headers. Finned centers are brazed between each adjacent pair of tubes for heat transfer by convection. Vessel-like members are placed at each header to form tanks therewith which are in fluidic communication with the tubes.

Brazing of aluminum-base components to form a heat exchanger is complicated by the inherent presence of an aluminum oxide layer on the surface of such components when exposed to an atmosphere containing oxygen. The oxide layer cannot be readily wetted, such that the formation of a strong metallurgical bond between a braze alloy and the aluminum members is significantly inhibited. To overcome such difficulties, one brazing technique in practice involves an inert atmosphere furnace operation. To destroy and remove the oxide layer, the assembly or its individual components are typically sprayed with or dipped into a water-based flux mixture prior to the brazing operation. The assembly is then dried to evaporate the water, leaving only the powdery flux solids on all of the external surfaces of the assembly. During brazing, the flux removes the oxide layer so as to expose the underlying aluminum surface to the braze alloy.

The brazing operation is complicated by the numerous brazements required, particularly when assembling a headered tube-and-center type heat exchanger, wherein each tube must be brazed to both headers and its corresponding finned centers during a single brazing operation. Typically, the brazements are achieved by employing an aluminum alloy brazing stock material to form the tubes, headers and/or finned centers. The aluminum alloy brazing stock material consists, for example, of an appropriate aluminum alloy core which has been clad on at least one side with an aluminum-base brazing alloy. Generally, the brazing alloy has been provided on both surfaces of the finned centers and on only the external side of the header, i.e., the side through which the tubes are inserted.

The cladding layers are generally an aluminum-silicon eutectic brazing alloy which is characterized by a melting point of about 575° C. to about 610° C., such that the brazing alloy has a lower melting temperature than that of the core aluminum alloy, which is typically at least about 630° C. The brazing operation involves carefully raising the temperature of the assembly such that only the clad layers of brazing alloy melt during the brazing operation. The brazing alloy then flows toward the desired joint regions and, upon cooling, solidifies to form the brazements.

Conventionally, it is known to provide the brazing alloy as 1) a foil which is brazed to the extruded tubes of a tube-and-center type heat exchanger, 2) a molten coating which is deposited onto the extruded tubes, or 3) a liner on an ingot which is hot and cold rolled to produce a silicon-clad aluminum alloy foil used to form the finned centers and headers of a headered tube-and-center type heat exchanger or finned centers of a serpentine tube-and-center type heat exchanger. A shortcoming of the first two above-described processes, i.e., the brazed foil and molten coating processes, is that there are two fluxing operations required: the first to adhere the brazing alloy to the tube's aluminum alloy core, and a second to braze the tubes to the finned centers during the braze furnace operation. The need for two fluxing operations is disadvantageous in that the additional flux, including its application and removal, add costs to the final assembly. The additional flux also aggravates the tendency for the flux to corrode the interior of the furnace, resulting in additional maintenance and repair of the furnace.

Another disadvantage with the brazed foil and molten coating processes is that the silicon within the brazing alloy tends to diffuse into the aluminum alloy core at the elevated temperatures required for the brazing operation. As a result, the corrosion resistance of the brazing alloy is reduced and, due to the reduced silicon content in the brazing alloy, the furnace temperatures required to melt the brazing alloy are higher.

The general practice of cladding the aluminum alloy core with an aluminum-silicon brazing alloy also tends to be disadvantageous in that the silicon content of the clad brazing alloy may vary significantly. For every one weight percent variation in silicon within the brazing alloy, the melt temperature of the brazing alloy can vary by about 10° F. This variability in silicon content significantly complicates the process control for the subsequent furnace braze operation.

A solution to the above problems is disclosed in U.S. Pat. Nos. 4,615,952 and 4,891,275 to Knoll, which involves a continuous coating process, wherein a zinc-base alloy is substituted for the conventional aluminum-silicon alloy. In particular, Knoll teaches a novel process by which the zinc-base alloy can be deposited on the surface of an extruded aluminum alloy profile, such as a tube for a heat exchanger, so as to serve as a soldering or low temperature brazing material when properly melted during a furnace operation. The coating process is conducted immediately after the aluminum alloy tube is extruded and within an inert atmosphere, such that the formation of an aluminum oxide layer is inhibited. As a result, the zinc-base alloy is able to bond to the surface of the aluminum alloy tube without the use of a flux. The aluminum alloy tubes may then be soldered or brazed to form a heat exchanger, with the zinc-base alloy coating serving as the brazing material. An additional benefit associated with the processes taught by Knoll is that the zinc-base alloy coating improves the corrosion resistance of the heat exchanger formed therewith, not only by minimizing the use of flux, but also because the zinc serves as a sacrificial anode, thus improving the corrosion performance of the heat exchanger through the suppression of pitting.

It would be advantageous to provide further improvements in coating processes for the coating of aluminum alloy profiles, such as a tube or microtube of a tube-and-center type heat exchanger, with a zinc-base alloy, so as to eliminate the requirement for an aluminum-silicon clad brazing alloy for purposes of soldering or brazing the tube. It would also be advantageous that such an improved process be sufficiently versatile so as to permit the deposition of the zinc-base alloy coating after an aluminum oxide layer has formed on the tube. It would be additionally desirable if the improved method were capable of forming a zinc alloy coating on tubes and microtubes used to form a heat exchanger, such that the coating thickness could be closely controlled to achieve a minimal thickness for a particular application, so as to minimize the weight and material used to form the heat exchanger.

SUMMARY OF THE INVENTION

It is an object of this invention to provide a method for coating an aluminum alloy profile suitable for use as a heat exchanger component, such as a tube or microtube.

It is a further object of this invention that such a method employ a zinc-base alloy which is deposited on the profile to form a zinc-base alloy coating that serves as a soldering or brazing alloy during the formation of the heat exchanger.

It is another object of this invention that such a method produce an aluminum alloy profile with a uniform coating which is of minimal thickness, yet is sufficiently thick to provide corrosion protection for the profile and/or serve as a solder or braze coating.

It is yet another object of this invention that such a method be capable of a high through-put rate, so as to make the method highly suitable for use in mass production.

In accordance with a preferred embodiment of this invention, these and other objects and advantages are accomplished as follows.

According to the present invention, an improved method is provided for coating an aluminum alloy profile, such as a tube or microtube, with a corrosion-resistant zinc alloy coating which is suitable for use as a soldering or brazing alloy. In particular, the method is particularly suitable for the coating of aluminum alloy tubes and microtubes used to form soldered or brazed heat exchanger units for automotive applications, such as the condenser for an air conditioning system. The method involves processing steps which enable the use of a quantity of tubing which has been previously formed, such that a layer of aluminum oxide is present on the tubing.

Generally, the method is a continuous, high speed process which involves removing the aluminum oxide layer from the tubing so as to allow the zinc-base alloy to be immediately deposited on the tubing. The method further enables precision control of the zinc-base alloy coating thickness, so as to minimize the presence of excess coating on the tubing. The resulting zinc-base alloy coating is equally suitable for use as corrosion protection, a soldering alloy, or as a brazing alloy, and enables the tubing to be joined at temperatures between the melting point of the zinc-base alloy and the melting point of the aluminum alloy used to form the tubing.

The method of this invention allows for the use of an aluminum alloy profile, such as a length of tube or microtube, on whose surface is formed an aluminum oxide layer. Generally, the presence of the aluminum oxide layer on the profile prevents a metallic coating from metallurgically adhering to the profile. The aluminum alloy profile is heated and then immersed in a molten bath containing the zinc-base alloy. Alternatively, the profile may be immersed directly into the molten bath, allowing the molten bath to sufficiently raise the temperature of the profile for the subsequent coating process of this invention. Generally, the duration for which the profile must be immersed in the molten bath to suitably raise the temperature of the profile is dependent on the temperature of the molten bath. With either approach, the profile is immersed in the molten bath while simultaneously being subjected to ultrasonic energy, which serves to remove the aluminum oxide layer on the profile. As a result, a coating of the zinc-base alloy is immediately deposited onto the surfaces of the aluminum alloy profile as the oxide layer is removed from the profile. Unexpectedly, the entire process for removal of the aluminum oxide layer and deposition of the zinc-base alloy coating occurs in less than about one second when practiced in accordance with this invention.

The aluminum alloy profile is then immediately subjected to a device which is capable of controlling the thickness of the zinc-base alloy coating deposited on the profile. The profile and zinc-base alloy coating are then sufficiently cooled so as to substantially solidify the coating. The profile is then collected in a manner that maintains a substantially constant tension on the profile during the coating process.

The aluminum alloy profiles which are coated with the zinc-base alloy in accordance with the method of this invention are suitable for both serpentine and headered tube-and-center type heat exchangers, as well as other brazed assemblies which utilize an aluminum-base tube or microtube. The teachings of this invention are also applicable to the formation of soldered assemblies which utilize an aluminum-base tube.

The coating process of this invention is capable of producing coatings of precise thicknesses. As a result, the thickness of the zinc-base alloy coating formed in accordance with this invention can be accurately controlled within a range of about 0.5 to about 2 micrometers. At such thicknesses, the zinc-base alloy coating is able to furnish significant corrosion protection to the tube or microtube, as well as to the final heat exchanger assembly, as a sacrificial coating. For soldering and brazing operations, a greater thickness of the zinc-base alloy coating is required, generally on the order of about three to about nine micrometers, though thicker coatings may be preferable depending on the particular application. Because of the precise coating method of this invention, the thickness of the coating can be precisely controlled within the above range, so as to produce a minimum coating thickness for a particular soldering or brazing application. Consequently, the weight of the tube/microtube and the final heat exchanger assembly can be minimized, while simultaneously assuring the presence of a sufficient amount of filler metal for the soldering or brazing operation.

Accordingly, an advantage to the present invention is that the process of this invention provides a continuous, high speed process for depositing an adherent zinc-base alloy coating on an aluminum alloy profile, such as a tube or microtube used to form a heat exchanger. The process permits the direct use of an aluminum alloy profile on which is formed an aluminum oxide, such that the profile can be coated at any convenient time after its fabrication. Furthermore, profiles coated with the zinc-base alloy can generally be brazed at any temperature between the melting point of the zinc-base alloy and the melting point of the aluminum alloy, a range which is significantly broader than that available when using aluminum-silicon clad brazing alloys.

Another advantage to the present invention is that the thickness of the zinc-base alloy coating can be closely controlled to furnish corrosion protection and provide sufficient filler metal for a subsequent soldering or brazing operation, while contributing minimal weight to the profile and the final soldered or brazed assembly. In particular, controlled thicknesses of as little as about 0.5 to about 2 micrometers can be deposited in order to provide corrosion protection for a profile, while greater thicknesses can be precisely deposited in order to form a coating which, in addition to corrosion protection, accurately provides the minimum amount of filler metal required for a soldering or brazing operation, such that minimal weight is contributed to the profile by the coating.

The resulting coated aluminum alloy profile is also desirable from the standpoint that a flux is not required for adherence of the zinc-base alloy coating to the profile. In addition, profiles processed in accordance with this invention avoid the disadvantages associated with the use of aluminum-silicon brazing alloys as a cladding material for brazeable tubes.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawing wherein.

DETAILED DESCRIPTION OF THE INVENTION

Figure 1:
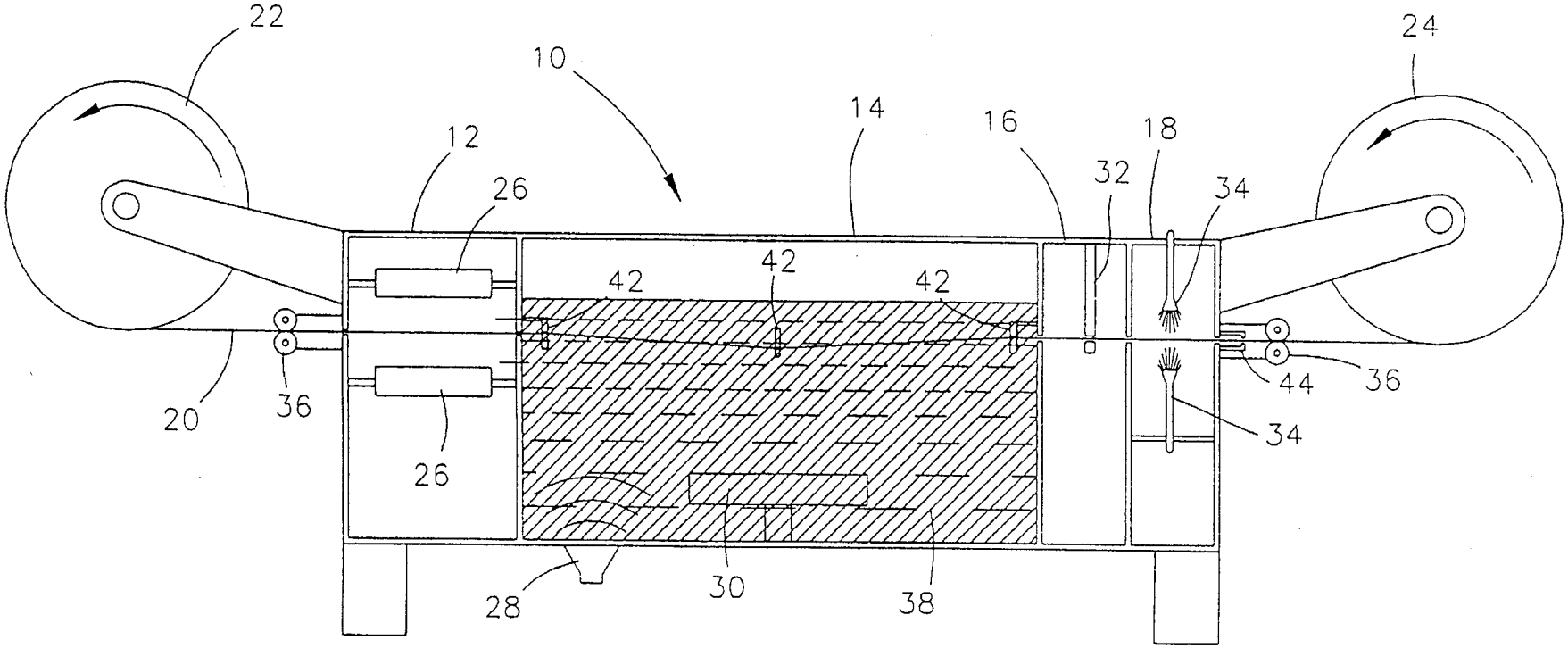
FIG. 1 is a schematic representation of a coating process in accordance with this invention, as well as a schematic representation of an apparatus by which such a coating process is performed.

An improved process is provided for forming a zinc-base alloy coating on an aluminum alloy profile, such as a tube or microtube used in the assembling and brazing of a heat exchanger which is suitable for automotive applications. The process of the present invention is a continuous, high speed coating technique which can utilize aluminum alloy profiles on which an aluminum oxide is present. Accordingly, this invention encompasses an operation by which the aluminum oxide layer is removed so as to enable the zinc-base alloy to wet and metallurgically adhere to the surface of the aluminum alloy profile. The process of this invention also is capable of closely controlling the thickness of the zinc-base alloy coating, such that a sufficient but minimal amount of coating is present to furnish corrosion protection, and/or provide sufficient filler metal for a subsequent soldering or low temperature brazing operation.

Generally, and as used in the following description of the present invention, the term "profile" is used to describe an elongate aluminum member having a cross-sectional shape, such as for example, an angle, I or H beam, or flange. More particularly, and with reference throughout, a profile will denote an elongate aluminum alloy member having a tubular shape. Such shapes include circular cross-sections, as well as generally oval cross-sections such as that of a microtube, each of which is known and utilized to form heat exchangers.

Profiles such as tubes and microtubes for heat exchangers are generally formed as extrusions from a variety of aluminum alloys, examples being the AA 1000, 3000 and 6000 series, and more particularly AA 1060, AA 1435, AA 3003 and AA 3102, as designated by the Aluminum Association (AA). Those skilled in the art will recognize that the teachings of this invention are not limited to the particular aluminum alloys used by example in the following description, but can generally be considered to encompass a wide variety of aluminum-base alloys. Typically, the length of an extrusion will greatly exceed the necessary tube length for a particular application, necessitating that the desired length of tube be cut from the extrusion. An extruded tube or microtube can generally be formed in a variety of cross-sectional sizes and shapes and designed to have a high burst pressure, characteristics which are advantageous for use in a heat exchanger. Generally, microtubes have a size and shape which differ significantly from standard tubes used in the heat exchanger industry, in that microtubes have a smaller, substantially oval-shaped cross-section so as to enhance heat transfer to and from the surrounding air, as well as decrease the pressure drop through the heat exchanger. In addition, internal webs are formed within microtubes which serve to enhance burst pressure.

In accordance with the teachings of this invention, and contrary to the prior art, the aluminum alloy profile from which such tubes and microtubes are cut is not clad with an aluminum-silicon brazing alloy, but is coated with a suitable zinc-base alloy. Alloys found suitable for use with the method of this invention generally contain about one to about twelve weight percent aluminum, with the balance being substantially zinc. A preferred eutectic alloy contains about five weight percent aluminum, with the balance being substantially zinc (Zn—5Al). The optimal aluminum content within the above range will depend significantly on the specific application for which the profile is to be used, as will be apparent to those skilled in the art. Furthermore, though the above alloys are generally preferred, those skilled in that art will recognize that other zinc-base alloys could be used.

The preferred zinc-aluminum alloys are suitable for use in soldering and brazing applications, in that the melting temperatures of these alloys generally range between about 382° C. and about 420° C., with the preferred eutectic Zn—5Al alloy having a melting temperature corresponding to the minimum within that range. As such, these zinc-base alloys are compatible with conventional soldering temperatures, which are generally below about 450° C., and compatible with conventional brazing temperatures, which are generally above about 450° C.

In accordance with this invention, the preferred zinc-base alloys can be metallurgically adhered to the profile in sufficient quantities so as to enable the formation of the necessary solder or braze fillets between the tube and the remainder of the heat exchanger assembly, while also providing corrosion protection through the diffusion of the zinc-base alloy into underlying aluminum alloy. Importantly, the process of this invention is also capable of closely controlling the thickness of the zinc-base alloy coating, such that a minimum amount of the preferred zinc-base alloy can be coated on the profile to comply with the particular requirements of an application.

More specifically, the zinc-base alloys can be controllably coated on the profile at about seven to about fourteen grams per square meter, corresponding to a coating thickness of about one micrometer. Generally, a substantially uniform coating thickness of about one to about two micrometers will provide a sufficient amount of the general purpose zinc-base alloy to provide corrosion protection for a microtube. For microtubes intended to be brazed at temperatures of up to about 600° C. to unclad finstock for a heat exchanger in lieu of using braze-clad finstock, the Zn—5Al alloy is preferably coated on the profile 20, as shown in the accompanying figure, to a thickness of about three to about nine micrometers. Greater coating thicknesses of as much as thirty micrometers may be required, depending on the temperature utilized as well as the geometry of the articles being brazed together.

For conventional soldering applications (i.e., below about 450° C.), the Zn—5Al alloy is preferably coated on the profile 20 to a thickness of about twenty to about forty micrometers. Again, such thicknesses will provide a sufficient amount of the zinc-base alloy to provide corrosion protection, eliminating the requirement for conventional corrosion-resistant coatings, such as chromate coatings. Furthermore, significant cost savings are possible in comparison to conventional unclad profiles which require the application of a braze filler metal on the centers. Significant savings in terms of reduced material costs, tooling costs and weight are also possible in comparison to conventional finstock clad with aluminum-silicon alloy.

A suitable process apparatus 10 for carrying out the preferred coating process of this invention is schematically illustrated in FIG. 1. The process apparatus 10 generally includes a preheating apparatus 12, a coating apparatus 14 in which a molten bath 38 is contained, a wiper apparatus 16 for controlling the thickness of the coating, and a quenching apparatus 18 for solidifying the coating. To guide the profile 20 through the process apparatus 10, conventional position control devices such as guides or rollers 36 may be used outside of the coating apparatus 14, while guides 42 are preferably used within the coating apparatus 14. Each of the above guide devices is well known in the art and will not be described in further detail.

While the process of the present invention will be further described in the context of a preferred embodiment, those skilled in the art will recognize that the structural aspects of the process apparatus 10 utilized in the teachings of this invention can be altered considerably, and yet accomplish the objects of the invention.

As is conventional, an elongate aluminum profile 20 of the type described above may be collected and stored on large reels 22 and 24, as shown in FIG. 1, though it is understood that other devices can be employed. As shown, the reels 22 and 24 are designated as a feed reel 22, denoting the reel from which the profile 20 is dispensed for the coating process, and a take-up reel 24, denoting the reel onto which the profile 20 is collected after the coating process. As is conventional, the take-up reel 24 pulls the profile 20 from the feed reel 22 so as to maintain tension on the profile 20. The tension can be controlled with a conventional tension control system (not shown) to impose a substantially constant tensile stress on the profile 20 which is below the plastic deformation limit of the profile 20 at the relevant process temperatures, which will be noted below.

As a particularly significant aspect of this invention, the processing apparatus 10, as determined by the take-up reel 24 and tension control system, is adapted to operate at linear speeds of at least 50 feet per minute, and more preferably at linear speeds of at least about 150 feet per minute. Speeds of about 600 feet per minute have proven successful with the coating process of this invention, with even higher speeds being foreseeable depending on the capability of the equipment being used. In contrast, prior art coating systems used in the steel galvanizing industry have typically been limited to operating at line speeds of about 400 feet per minute or less.

With further reference to FIG. 1, the coating process of this invention is preferably conducted as follows. As the profile 20 leaves the feed reel 22, it enters the preheating apparatus 12, which may form an integral part of the process apparatus 10. Within the preheating apparatus 12, a conventional heating device 26, such as a gas flame element or an induction or convection heater, is provided to continuously and uniformly preheat the surface of the profile 20 as it passes through the preheating apparatus 12. Alternatively, the profile 20 may be immersed directly into the molten bath 38 from the feed reel 22, allowing the molten bath 38 to sufficiently raise the temperature of the profile 20 for the coating process. Generally, the duration for which the profile 20 must be immersed in the molten bath 38 to suitably raise the temperature of the profile 20 is dependent on the temperature of the molten bath 38, which may be as low as about 390° C. or as high as about 450° C. With either approach, the intent is to raise the surface temperature of the profile 20 such that a coating of the zinc-base alloy will still be retained on the profile 20 in a substantially molten state as the profile 20 enters the wiper apparatus 16. For this purpose, the surface temperature of the profile must be slightly lower or slightly higher than the nominal melting temperature of the particular zinc-base alloy to be deposited as a coating on the profile 20, while preferably maintaining the core temperature of the profile 20 to be below the melting temperature of the zinc-base alloy. Potentially, the molten bath 38 could be used to superheat the surface of the profile 20, if desired. However, use of the heating device 26 is preferred over the use of the molten bath 38 to heat the profile 20, in that an excessively long molten bath reservoir may be required to suitably heat the profile 20 for the higher line speeds practiced by the present invention (i.e., 600 feet per minute or more).

Appropriate preheating of the profile 20 is necessary in that the zinc-base alloy would otherwise solidify on the surface of the profile 20 prior to entering the wiper apparatus 16, thereby preventing the wiper apparatus 16 from operating properly. However, it is foreseeable that under some circumstances the surface temperature of the profile 20 may be less than the melting temperature of the zinc-base alloy, and yet provide suitable coating characteristics.

From the preheating apparatus 12, the profile 20 continues directly to the coating apparatus 14 which contains the molten bath 38 of the zinc-base alloy preferred for the particular coating application. The higher line speeds made possible by this invention ensure that the surface temperature of the profile 20 will not have cooled appreciably after leaving the preheating apparatus 12. A suitable heating device 30 is employed to maintain the melt temperature of the molten bath 38 at or above the melting temperature of the particular zinc-base alloy (i.e., about 382° C. to about 420° C.). In general, it is also important to maintain a substantially constant melt temperature so as to achieve a consistent coating quality and thickness. To promote a uniform temperature throughout the molten bath 38, the molten bath 38 is preferably circulated within the coating apparatus 14 using conventional devices (not shown).

A critical aspect of this invention is that one or more devices for removing the aluminum oxide layer on the profile 20 is provided as an integral part of the coating apparatus 14. In particular, ultrasonic energy is preferably employed to remove the aluminum oxide layer as well as any other impurities from the surface of the profile 20, so as to enable wetting of the underlying aluminum alloy surface by the molten bath 38. For this purpose, ultrasonic solder pots or horns 28 of the type known in the art are preferably used. As is conventional with such devices, ultrasonic waves are generated using a power supply to provide an electrical output at an ultrasonic frequency, for example, about 20 to about 30 kHz. A converter, such as piezoelectric transducer, converts the electrical energy into mechanical vibrations. These vibrations are then relayed to the horn 28, which transmits the resulting ultrasonic waves to the molten bath 38.

The use of ultrasonic wave generating devices is known to those skilled in the art in terms of batch processing, such that further discussion of the individual components will be omitted here. However, in contrast to that known and attempted previously in the prior art, the present invention is a continuous hot dip coating process involving high line speeds which correspond to an extremely short immersion time, on the order of about 0.1 to about 1 second. Accordingly, in a preferred embodiment, a sufficient number of horns 28 are installed in the walls of the coating apparatus 14 so as to generate sufficient ultrasonic energy to remove the aluminum oxide layer from the profile 20 while immersed in the molten bath 38. In accordance with this invention, removal of the aluminum oxide layer occurs rapidly within the coating apparatus 14 so as to successfully permit wetting and adhesion of the profile 20 by the zinc-base alloy in the molten bath 38, such that a metallurgical bond is created in which the zinc alloy diffuses slightly into the profile 20.

To minimize and closely control the thickness of the resulting zinc-base alloy coating, the profile 20 proceeds from the coating apparatus 14 to the wiper apparatus 16, wherein a wiper 32 is housed. Suitable wipers 32 include mechanical wipers, gas knives and flame knives. As is known in the art, gas knives utilize air, nitrogen, or another suitable gas to remove excess coating from the profile 20, while flame knives utilize a burning gas such as natural gas to remove excess coating. Each of the above types of wipers are well known in the art, such that a detailed description will be omitted. One or more of these wipers 32 may be used within the wiper apparatus 16 at any given time to achieve the desired coating thickness. When using a gas knife to control the coating thickness, position control of the profile 20 can be particularly critical. Generally, the profile 20 should be positioned slightly below center of the gas knife so as to compensate for the effect of gravity on the as-yet molten coating layer. In addition, a gas flame (not shown) is preferably used immediately upstream of the gas knife so as to facilitate its operation, as is known in the art.

From the wiper apparatus 16, the profile 20 then continues to the quenching apparatus 18, where the coating is fully solidified and the profile 20 is cooled. An important function of the quenching apparatus 18 is to cool the profile 20 to a temperature which is below the critical temperature for grain growth in the profile's particular aluminum alloy. As is conventional, the quenching apparatus 18 may consist of a direct water quench using water spray nozzles 34. When using a water spray quench as shown, the coating should preferably be sufficiently solidified before entering the quenching apparatus 18 so as to reduce the tendency for the water spray to create a rough surface on the coating, a tendency which appears to be encouraged by the high line speeds achieved by this invention. If a water immersion quench is utilized, this tendency appears to be minimal over a wide operating range of speeds and temperatures.

In order to fully implement this invention with all of its described advantages, a measuring device 44 is preferably employed to monitor the thickness of the coating as the profile 20 leaves the process apparatus 10. As shown, the measuring device 44 may be in-line so as to enable the thickness of the coating to be continuously monitored, though off-line measuring techniques may also be suitable.

As noted before, profiles 20 coated in accordance with the process and the process apparatus 10 described above are capable of being processed at line speeds of at least 600 feet per minute or more, all while maintaining coating thicknesses of as little as about 0.5 to about 2 micrometers. Such high line speeds are desirable for use in mass production, in that they maximize the length of the profile 20 which can be coated in a given period. The process is also highly desirable in mass production, as well as low volume production, in that it permits the direct use of an aluminum alloy profile on which is present an aluminum oxide. As a result, the profile 20 can be coated at any convenient time after its fabrication.

In addition, the process of the present invention is advantageous from the standpoint that a flux is not required to adhere the zinc-base alloy coating to the profile 20. Profiles 20 processed in accordance with this invention also avoid the disadvantages associated with the use of aluminum-silicon brazing alloys as a cladding material for brazeable tubes. As previously described, the resulting product, whether a microtube or a more standard circular tube, is coated with a highly uniform zinc-base alloy coating that affords corrosion protection as well as ample filler metal for soldering and low temperature brazing operations, while contributing minimal weight to the tube or microtube, as well as the final soldered or brazed assembly.

While our invention has been described in terms of a preferred embodiment, it is apparent that other forms could be adopted by one skilled in the art, such as by modifying the structural and operational interrelationships between the processing apparatus 10 and its individual processing segments; or by modifying the shape or the cross-section of the profile 20; or by utilizing a different zinc-base alloy; or by modifying the temperatures and/or durations of the processing steps employed. Accordingly, the scope of our invention is to be limited only by the following claims.

The embodiments of the invention in which an exclusive property or privilege is claimed are defined as follows:

1. A process for continuously coating an aluminum-base profile with a zinc-base alloy, the process comprising the steps of:

providing an aluminum-base profile on whose surface is formed an oxide layer;

transporting the aluminum-base profile through a molten bath comprising the zinc-base alloy such that only a portion of the aluminum-base profile is immersed in the molten bath at any given instant, any given portion of the aluminum-base profile immersed in the molten bath being exposed to a means for transmitting ultrasonic energy into the molten bath so as to remove the oxide layer present on the aluminum-base profile, any given portion of the aluminum-base profile being immersed in the molten bath for a duration sufficient to substantially remove the oxide layer from the aluminum-base profile and deposit a coating of the zinc-base alloy onto the aluminum-base profile such that the coating metallurgically bonds to the aluminum-base profile;

cooling the coating so as to substantially solidify the coating; and continuously pulling the aluminum-base profile so as to sequentially draw the aluminum-base profile through the molten bath at a rate of at least about 150 feet per minute.

2. A process as recited in claim 1 further comprising the step of subjecting the aluminum-base profile to a means for controlling the thickness of the coating deposited on the aluminum-base profile.

3. A process as recited in claim 2, wherein the aluminum-base profile is heated so as to sufficiently raise the surface temperature of the aluminum-base profile such that the coating is retained on the aluminum-base profile in a substantially molten state as the aluminum-base profile encounters the thickness controlling means.

4. A process as recited in claim 1 wherein the thickness of the coating is about 0.5 micrometer or greater.

5. A process as recited in claim 1 wherein the duration for which any given portion of the aluminum-base profile is immersed in the molten bath is less than about one second.

6. A process for continuously coating an elongate aluminum-base profile with a zinc-base alloy, the process comprising the steps of:

providing an elongate aluminum-base profile on whose surface is formed an oxide layer;

continuously dispensing the aluminum-base profile from a dispensing means;

transporting the aluminum-base profile through a molten bath comprising the zinc-base alloy such that only a portion of the aluminum-base profile is immersed in the molten bath at any given instant, any given portion of the aluminum-base profile immersed in the molten bath being exposed to ultrasonic energy so as to remove the oxide layer present on the aluminum-base profile, any given portion of the aluminum-base profile being immersed in the molten bath for a duration of less than about one second so as to substantially remove the oxide layer from the aluminum-base profile and deposit a coating of the zinc-base alloy onto the aluminum-base profile such that the coating metallurgically bonds to the aluminum-base profile;

subjecting the aluminum-base profile to a means for controlling the thickness of the coating deposited on the aluminum-base profile;

quenching the coating so as to substantially solidify the coating; and continuously accumulating the aluminum-base profile on an accumulating means so as to pull the aluminum-base profile through the molten bath at a rate of at least about 150 feet per minute while maintaining a substantially constant tension on the aluminum-base profile.

7. A process as recited in claim 6 further comprising the step of preheating the aluminum-base profile prior to immersing the aluminum-base profile in the molten bath.

8. A process as recited in claim 6 wherein the coating is controlled to a thickness of between about 0.5 and about 2 micrometers.

9. A process as recited in claim 6 wherein the surface temperature of the aluminum-base profile is sufficient such that the coating is retained on the aluminum-base profile in a substantially molten state as the aluminum-base profile encounters the thickness controlling means.

10. A process as recited in claim 6 wherein the duration for which any given portion of the aluminum-base profile is immersed in the molten bath is about 0.1 to about one second.

* * * * *